US005482357A

United States Patent [19]

Wint et al.

[11] Patent Number: 5,482,357

[45] Date of Patent: Jan. 9, 1996

[54] PLASMA BLASTING PROBE ASSEMBLY

[75] Inventors: Gregory Wint, Pierrefonds; Michel Ménard, Pincourt, both of Canada

[73] Assignee: Noranda, Inc., Toronto, Canada

[21] Appl. No.: 395,469

[22] Filed: Feb. 28, 1995

[51] Int. Cl.[6] ..... E21C 37/16

[52] U.S. Cl. ..... 299/14; 175/16

[58] Field of Search ..... 299/13, 14; 175/16; 166/63

[56] References Cited

U.S. PATENT DOCUMENTS

| | | | |
|---|---|---|---|
| 3,583,766 | 6/1971 | Padberg, Jr. | 175/16 X |
| 3,679,007 | 7/1972 | O'Hare | 175/16 |
| 4,479,680 | 10/1984 | Wesley et al. | 299/14 |
| 5,106,164 | 4/1992 | Kitzinger et al. | 299/14 |

FOREIGN PATENT DOCUMENTS

| | | | |
|---|---|---|---|
| 2227505 | 1/1973 | Germany | 175/16 |
| 741611 | 4/1983 | U.S.S.R. | 299/13 |

*Primary Examiner*—David J. Bagnell
*Attorney, Agent, or Firm*—Fitzpatrick, Cella, Harper & Scinto

[57] ABSTRACT

The present invention is concerned with a probe assembly for plasma blasting or fragmenting a substance such as rock, concrete and the like. The probe assembly contains a probe made of two coaxial electrodes separated by a dielectric material; a termination box secured to the probe and coupled to an energy storage module, and containing electrical connections between the probe and the energy storage module; and dampening means for dampening the movement of the termination box and the probe after a blast.

14 Claims, 3 Drawing Sheets

PLASMA BLASTING PROBE ASSEMBLY

FIELD OF INVENTION

The present invention is concerned with a probe suitable for plasma blasting technology.

BACKGROUND OF THE INVENTION

Plasma blasting technology (PBT) refers to a technique of blasting a material using a high-power electrical discharge into that material. U.S. Pat. No. 5,106,164, which is hereby incorporated by reference, describes and claims such a technique. The implementation of this technology on the field requires several components, the main components being an electrical power source, an electrical energy storage module, a switch, a transmission line, and a probe assembly. The first 4 components, which are involved in the storage and delivery of the electrical energy, are all commercially available. However, very little information is available on the most critical component, namely the probe assembly. The probe assembly is the piece of equipment that is in direct contact with the substance to be blasted and, therefore has to withstand the mechanical shock associated with the blast.

A probe assembly is disclosed by O'Hare in U.S. Pat. No. 3,679,007. This probe was developed for drilling boreholes, and therefore, little energy is required for each blast. Energy can be computed using the following formula: $E=(CV^2)/2$, where E is the energy (in Joules), C is the capacity of the capacitor bank in (Farads), and V is the voltage across the capacitor bank (in Volts). In U.S. Pat. No. 3,679,007, it is specified that a 400 microfarads capacitor bank functioning at 6,000 volts, yields an energy of about 7,200 Joules.

There is however a great need for a probe assembly designed to actually blast a substance or material. To produce such a blasting effect, the probe must liberate a tremendous amount of energy in an extremely short period of time. To be of commercial interest, the probe assembly must therefore be able to provide such high amount of energy quickly, while simultaneously sustaining the high impact or shock caused by the fast liberation of energy. The probe assembly should be designed to resist to a plurality of blasts, preferably more than 500, before being replaced. The present application describes and claims a probe assembly having these properties.

SUMMARY OF THE INVENTION

In accordance with the present invention, there is now provided a probe assembly for plasma blasting or fragmenting a substance such as rock, concrete, frozen soil, or any other brittle material comprising:

- a probe comprising coaxial electrodes separated by a first dielectric material;
- an electrical termination box secured to the probe, the termination box being made of a second dielectric material contained in a rigid case and comprising electrical connections between the probe and an energy storage module;
- dampening means for dampening the movement of the termination box and the probe after a blast In a preferred embodiment, the electrodes are made of steel, and the termination box is made of a suitable dielectric material such as amorphous thermoplastic like polycarbonate contained in a steel case.

IN THE DRAWINGS

DETAILED DESCRIPTION OF THE INVENTION

The present invention is concerned with a probe assembly for plasma blasting capable of delivering several hundreds of blasts, preferably at least live hundred, of 300 kJ before being replaced. To use the probe assembly of the present invention, a hole is first drilled in the material to be blasted. The dimensions of the hole preferably vary from a diameter of about 50 mm to about 100 mm with a depth of from about 150 mm to about 1500 mm. These dimensions may be bigger or smaller, as long as they match closely the dimensions of the probe. An electrolyte is then introduced in the hole, followed by the probe. It should be noted that any conventional electrolyte may be used, water being the obvious most preferred choice because of its low cost. The electrolyte may be combined with a gelling agent such as bentonite or gelatin to make it more viscous so that it will not run out of the confined area before blasting.

Figure 3:
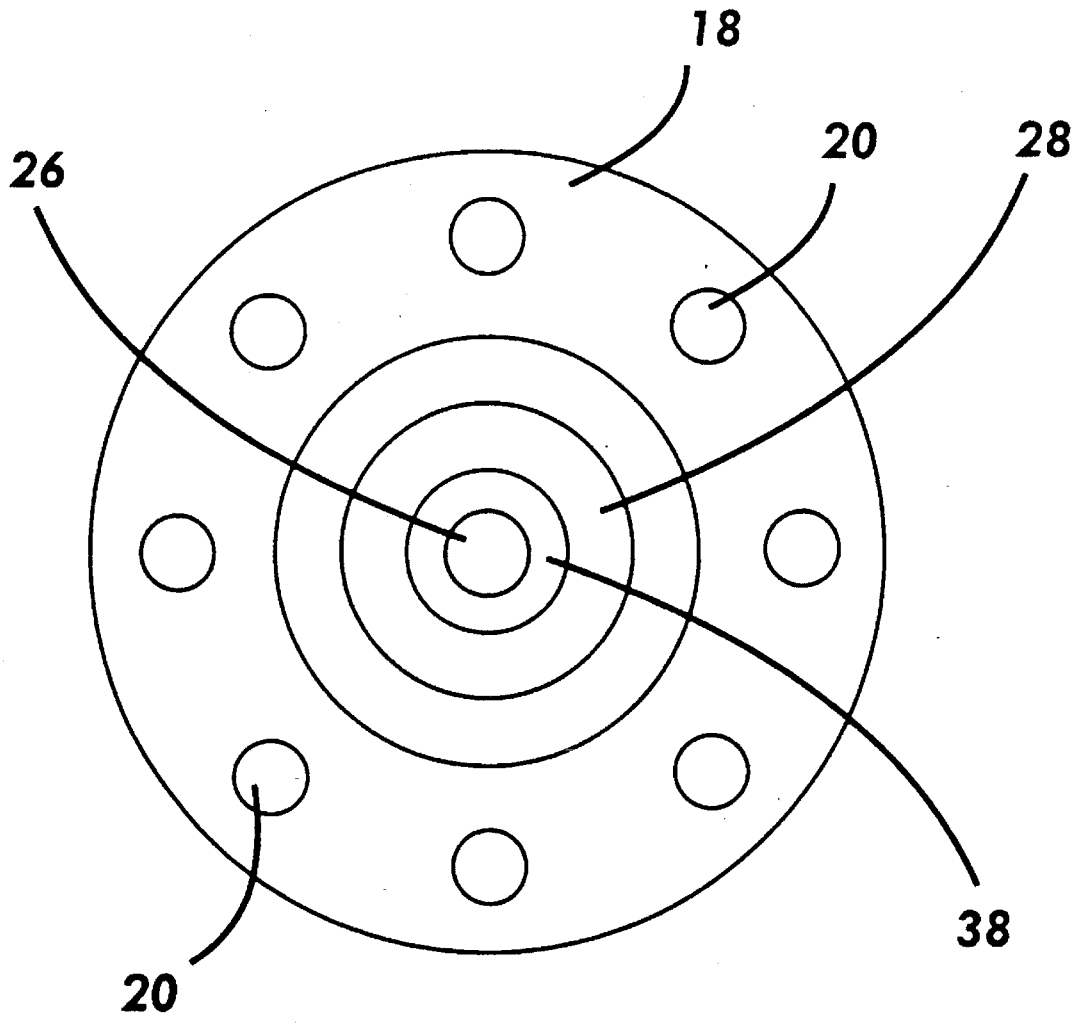
FIG. 3 illustrates a view along line 3—3 in FIG. 2.

When the probe is in place, over 300 kJ of energy is induced in the probe, resulting in the creation of dielectric breakdown of the electrolyte resulting in the formation of plasma causing a pressure within the confined area such that it is strong enough to blast the material in a similar manner as with an explosive charge. The probe may be used alone, or preferably mounted on a boom, as illustrated for example in FIG. 3 of U.S. Pat. No. 5,106,164.

The ratio length/diameter of the probe must be such that buckling is prevented, while simultaneously minimizing the energy required for the blast. A typical length of the probe is about 1.5 meters, and its total diameter is about 75 mm, with an insulator thickness of about 13 mm between the electrodes, but the probe may be longer if desired as long as buckling is prevented. It should also be noted that a longer probe is more susceptible to longitudinal deformations.

The electrical connections in the termination box are critical, since at energy levels superior to a few kilojoules, the connections invariably break because of their rigidity. The system that was successfully tried uses an intermediate termination point that permits connecting the flexible electrical conductors to the probe using massive brass clamps and connects sideways to flexible wires. The termination box itself follows the recoil movement of the probe. The mechanical contact between the probe and the termination box is insured by a steel flange rigidly welded or otherwise secured to the probe, rather than by the electrical connections. Prior experiments have shown that electrical connections are not reliable and fail quickly because of the strong mechanical forces applied repeatedly after each recoil movement caused by a discharge. The termination box has been found to overcome these major problems while limiting the lost of energy.

The recoil movement is dampened using a dampening system, and the movement of the termination box is guided by fixed rails. The termination box is closed on all sides except for a hole at the bottom for insertion of the probe, two holes on the side for insertion of the wires, and a lid on the front for inspection of the electrical connections.

The electrical conductors are flexible wires that cannot be too thick, because of the risk of fatigue failure after several recoil movements, nor too thin because of the risk of melting while transporting the current. A variety of wires and configurations including straight welding cables, hexapolar cables, and multiple sets of them connected in parallel have been tested. The best solution is to replace the wires with a plurality of coaxial cables. Multiple sets of wires connected in parallel are also acceptable.

The invention will now be described by referring to the drawings which illustrate preferred embodiments, and should not be construed as limiting the scope of the invention.

Figure 1:
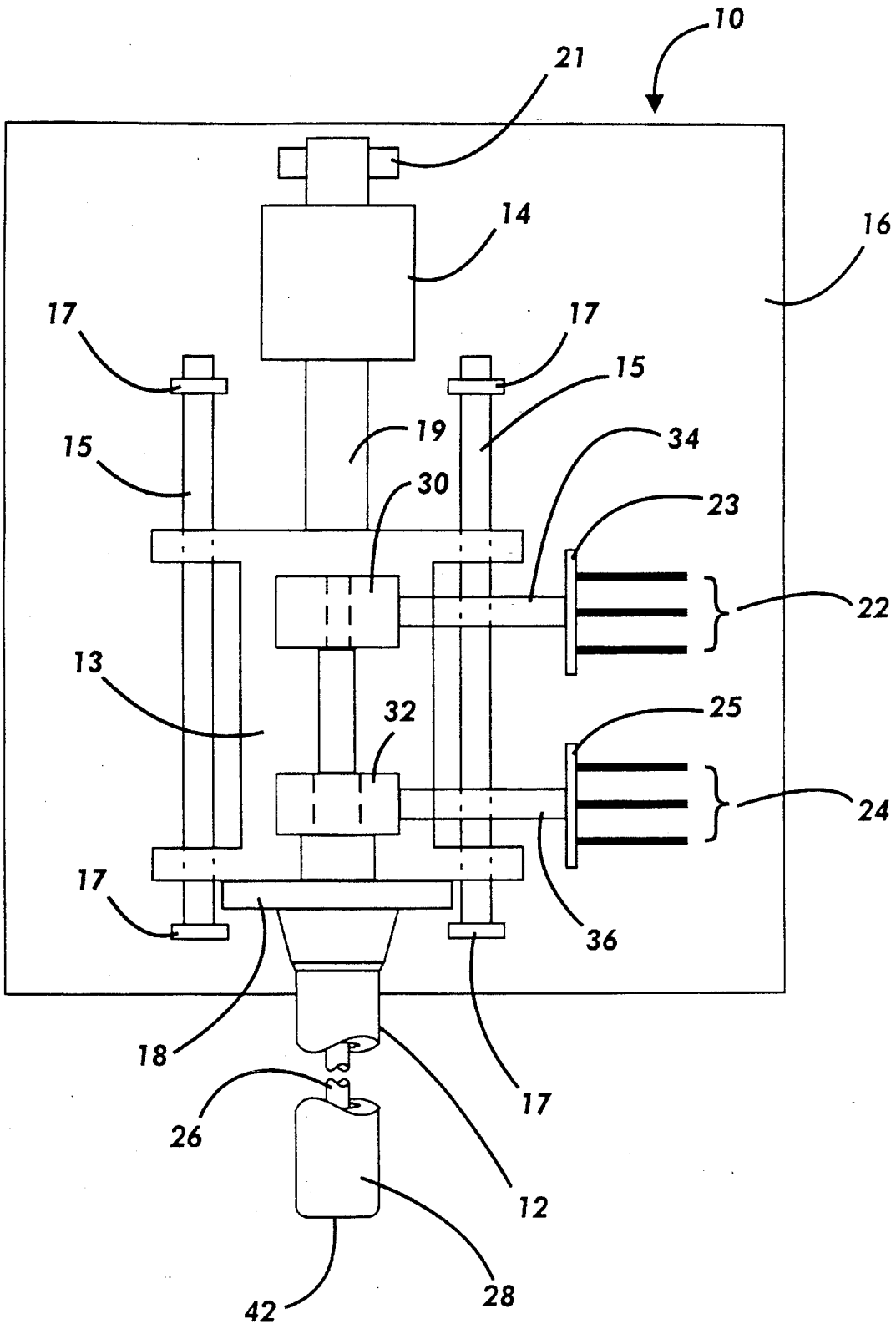
FIG. 1 illustrates a perspective view of the probe assembly according to the present invention.

Referring to FIG. 1, there is illustrated the present probe assembly 10 comprising a probe 12, a termination box 13 and a dampening device 14. Termination box 13 is mounted on rails 15 which are secured to a steel plate 16 with four brackets 17. A flange 18 preferably made of steel is welded or otherwise secured to probe 12 and screwed into termination box 13 with screws through holes 20 (see FIG. 3). Alternatively, flange 18 and electrode 28 may also be molded as a single piece. A strong recoil movement takes place every time a blast occurs, thus causing termination box 13 to slide in rails 15. The recoil movement is dampened by a dampening device 14 which may be a cylinder 19, as illustrated, or a spring, a coil or an air piston, or any other suitable shock absorber (or combinations thereof) provided on the top of termination box 13 to absorb the shock caused by the energy discharge. Dampening device 14 is also secured to steel plate 16 with brackets 21. The material of termination box 13, which houses the electrical connections between probe 12 and the energy storage module (not shown) must be highly dielectric and rigid. Polycarbonate materials like LEXAN™ (a polycarbonate resin), which is manufactured and sold by General Electric, and have shown to give excellent results.

The current is brought to the probe from an energy storage module through two flexible wires 22 and 24, that is, one for each electrode 26 and 28, each wire being divided in three smaller wires, preferably made of copper, brass or aluminum, connected at one end to a switch (not shown) and at the other end to brass plates 23 and 25. Electrodes 26 and 28 are clamped with brass clamps 30 and 32, which in return are in electrical contact with flexible wires 22 and 24 through rods 34 and 36. An alternative to this design would be to replace flexible wires 22 and 24 with a busbar which is swept with a brush mounted on termination box 13.

Figure 2:
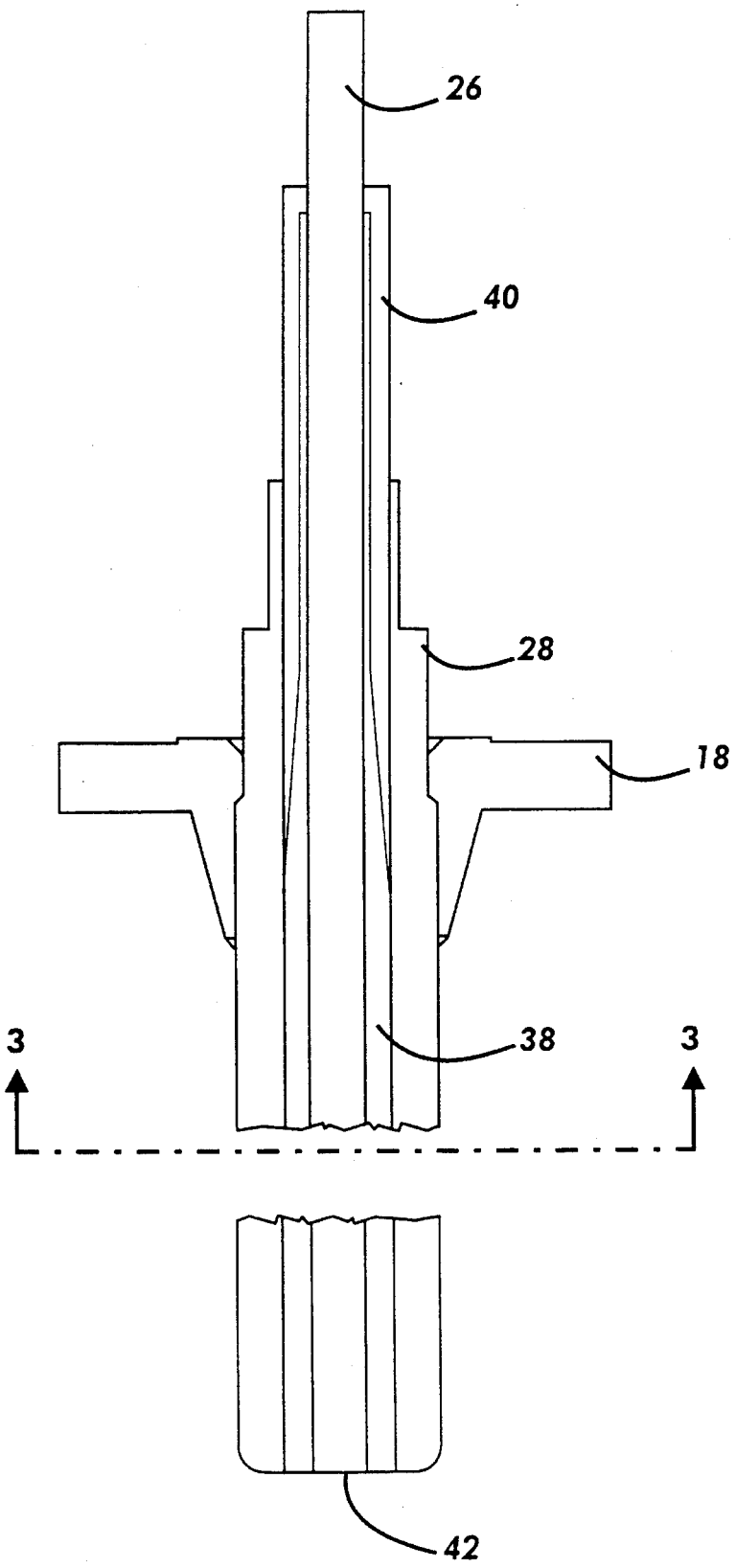
FIG. 2 illustrates a sectional view of the probe.

Referring to FIG. 2, it can be seen that electrodes 26 and 28 are coaxial and separated by a dielectric material 38. A glue such as epoxy, is preferably provided between dielectric material 38 and electrodes 26 and 28. Because of the high current going through the electrode, the choice of the dielectric material must be made carefully to insure proper insulation of both electrodes. Further, the dielectric material must be able to sustain repetitive strong mechanical impacts. Experience has shown that G-10, which is a commercial epoxy resin reinforced with fiberglass, polyepoxy, polycarbonate, polyurethane and ultra high molecular weight polyethylene (or combinations thereof) can be used, the latter being the most preferred since it is less rigid, and therefore has better resistance to cracking while being an excellent insulator. It should be noted that the longevity of a probe containing ultra high molecular weight polyethylene is significantly higher than that with the other insulators tested.

Because of the high mechanical impact after an energy discharge, the deformation of the probe has to be constrained at the top end of probe 12, inside termination box 13. This is done by surrounding the top of dielectric material 38 with a cap 40 of a fiber-reinforced material, such as G-10. It has been found that the absence of cap 40 significantly reduces the active life of the probe, and that it is advantageous that the section of cap 40 be tapered to maximize it efficiency.

Below cap 40, the section of probe 12 is constant over several feet, down to the blasting end 42 of probe 12. This feature allows one to cut a section, typically a few inches, of probe 12 as soon as the blasting damage to blasting end 42 impedes on the performance of the probe. In hard rock mining, such cutting may be necessary after from about 100 to 200 blasts, depending on the rocks blasted. The probe may be cut after a greater number of blasts, but the energy losses and the efficiency are greatly reduced if the tip of the probe is too severely damaged. The fact that the probe may be periodically cut is a significant advantage when working underground, since this operation is not time consuming, and allows the operator to resume working within a few minutes. The tip of the probe may be cut manually by the operator, or automatically with cutting means (not shown) coupled to the probe assembly.

Combined to probe assembly 10 is an energy storage system having a 2000 microfarads capacitor bank functioning at 18,000 volts, yielding an energy of about 324 kJ. This energy can be delivered, for example, at a rate of at least 100 megawatts per microseconds until a peak power of 3 gigawatts is reached. However, it should be noted that the discharge time is dependent on circuit inductance and can vary. Tests performed showed that the discharge time may vary by introducing and removing a series inductance.

Electrodes 26 and 28 can be made of copper, brass, steel, ELKONITE™ (a sintered powder of copper and tungsten) manufactured and sold by TIPALOY INC., or nickel (or combination thereof), steel being the most preferred because it is less susceptible to deformation, cheaper and readily available.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A probe assembly for plasma blasting comprising:

a probe comprising coaxial electrodes separated by a first dielectric material;

a termination box secured to the probe, the termination box being made of a rigid case containing a second dielectric material and comprising electrical connections between the probe and an energy storage module; and dampening means for dampening the movement of the termination box and the probe after a blast.

2. A probe assembly according to claim 1 wherein each electrode is clamped to a conductive rod in the termination box, and each conductive rod is connected to at least one flexible wire bringing the current from the energy storage module.

3. A probe assembly according to claim 1 wherein the electrical connections in the termination box are made of brass.

4. A probe assembly according to claim 1 wherein the electrodes are made of nickel, copper, steel, ELKONITE™, or combinations thereof.

5. A probe assembly according to claim 1 wherein the dampening means is a cylinder, a coil, a spring, or any other shock absorber means, or combinations thereof.

6. A probe assembly according to claim 1 wherein the first and second dielectric material are selected from the group consisting of an epoxy resin reinforced with fiberglass, polyepoxy, polyurethane, polycarbonate, ultra high molecular weight polyethylene or combinations thereof.

7. A probe assembly according to claim 6 wherein the first dielectric material is ultra high molecular weight polyethylene and the second dielectric material is a polycarbonate.

8. A probe assembly according to claim 7 wherein the first dielectric material comprises a cap of an epoxy resin reinforced with fiberglass in the termination box.

9. A probe assembly according to claim 1 further comprising means to cut the tip of the probe.

10. A probe assembly for plasma blasting comprising:

a probe comprising a flange and consisting in coaxial electrodes of steel separated by a layer of ultra high molecular weight polyethylene;

a termination box made of a polycarbonate material and slidably mounted on at least one rail, the termination box being secured to the probe through the flange, and comprising a pair of clamps clamping each an electrode; the termination box being coupled to an energy storage module through a pair of conductive rods having one end in electrical contact with a clamp and the other end connected to at least one flexible wire bringing the current from the energy storage module; and a cylinder coupled to a coil for dampening the movement of the termination box and the probe after a blast.

11. A probe assembly according to claim 10 wherein the layer of ultra high molecular weight polyethylene comprises a cap of an epoxy resin reinforced with fiberglass in the termination box.

12. A probe assembly according to claim 10 further comprising means to cut the tip of the probe.

13. A probe assembly according to claim 10 wherein the clamps and the conductive rods are made of brass.

14. A probe assembly according to claim 10 wherein the number of flexible wires is three.

* * * * *